US005186329A

United States Patent [19]

Fogelberg

[11] Patent Number: 5,186,329

[45] Date of Patent: Feb. 16, 1993

[54] PORTABLE TOOL HOLDER

[76] Inventor: Donald D. Fogelberg, 541 W. 98th St., No. 102, Bloomington, Minn. 55420

[21] Appl. No.: 821,440

[22] Filed: Jan. 15, 1992

[51] Int. Cl.[5] ..... B65D 85/20

[52] U.S. Cl. ..... 206/372; 206/373; 220/506; 220/528; 220/555; 220/735

[58] Field of Search ..... 206/372, 373, 349, 45, 206/822; 220/735, 528, 507, 505, 506, 555, 520, DIG. 13

[56] References Cited

U.S. PATENT DOCUMENTS

| | | | |
|---|---|---|---|
| 2,359,797 | 10/1944 | Schnider | 220/505 X |
| 2,835,406 | 5/1958 | Dickerson | 220/505 |
| 3,298,532 | 1/1967 | Wilcke . | |
| 3,887,077 | 6/1975 | Frey | 220/506 X |
| 4,305,511 | 12/1981 | Denholtz . | |
| 4,362,243 | 12/1982 | Deyesso et al. . | |
| 4,572,376 | 2/1986 | Wrennall | 220/507 X |
| 4,627,595 | 12/1986 | Rhodes et al. | 220/506 X |
| 4,715,499 | 12/1987 | Franklin | 206/373 |
| 4,850,092 | 7/1989 | Newarski | 206/373 X |
| 4,867,332 | 9/1989 | Mains . | |
| 4,911,295 | 3/1990 | Venegoni . | |
| 4,925,026 | 5/1990 | McKay . | |
| 4,947,998 | 8/1990 | Smeller . | |
| 4,993,551 | 2/1991 | Lindsay . | |
| 5,086,917 | 2/1992 | Dziersk et al. | 220/555 X |
| 5,088,618 | 2/1992 | Colombo | 220/506 X |

FOREIGN PATENT DOCUMENTS 1224465 6/1960 France .

*Primary Examiner*—Jimmy G. Foster
*Assistant Examiner*—Jacob K. Ackun, Jr.
*Attorney, Agent, or Firm*—Patterson & Keough

[57] ABSTRACT

A tool holder is disclosed especially adapted to be received within a standard five-gallon dry wall pail or like container. The tool holder is characterized in having an outer side wall, preferably tapered to be compatible with the taper of the dry wall pail or like container. The outer side wall surrounds a cavity within which tools may be stored. The cavity is subdivided by generally vertical walls into a number of tool compartments of various sizes, with the highest and deepest compartments located near the periphery of the cavity and the lowest and shallowest compartments located near the center of the cavity. In a preferred embodiment the tool compartments reflect an inclined plane spiral arrangement, the spiral being lowest in the center of the cavity and moving upward as the spiral approaches the tool holder periphery.

4 Claims, 1 Drawing Sheet

PORTABLE TOOL HOLDER

FIELD OF THE INVENTION

The present invention relates to a portable tool holder for workman's tools. More specifically, the present invention relates to a tool holder especially designed for ease of access to the tools carried by the holder, and which is adapted for storage and carrying within standard five gallon bucket containers.

BACKGROUND OF THE INVENTION

Tool boxes, totes, caddies and tool organizers are well known. More specifically, a number of tool holder designs have been proposed that attempt to take advantage of the ubiquitous five gallon plastic bucket as a tool organizer and caddy. Such designs comprise inserts that are received into a standard five gallon bucket (such as an empty dry wall compound bucket or paint container) and that include compartments for separating a variety of hand tools.

U.S. Pat. No. 4,362,243 to Deyesso et. al. discloses a tool holder insert adapted to engage the inner surface of the wall of a plastic bucket. The insert is annular in configuration and includes apertures and notches for holding tools in an upright position within the bucket. U.S. Pat. No. 4,867,332 to Mains discloses another annular ring insert for a standard five gallon bucket that allows for the upright storage of hand tools within the bucket. The Mains ring insert includes an outwardly and downwardly extending lip for engaging the upper rim of the bucket, whereas the Deyesso insert is held in place within the bucket by either a force fit between the ring and the inwardly tapered sides of the bucket, or with fasteners that extend through the bucket side wall.

U.S. Pat. No. 4,993,551 to Lindsay discloses a different approach to adapting a five gallon bucket into a tool holder. The Lindsay device comprises a tubular cloth panel which drapes and conforms over the inside and outside surfaces of a bucket, and includes inner pockets sewn on to the panel for receiving hand tools. Other alternative approaches are disclosed in U.S. Pat. No. 4,911,295 to Venegoni, and U.S. Pat. No. 4,925,026 to McKay. The Venegoni patent discloses a plurality of organizer trays stackable within a standard bucket. The McKay patent discloses an insert for a bucket that includes spring clips and a spiral spring tightly held against the inner side wall of the insert for holding tools in an upright position.

While the devices disclosed in the above noted patents provide different ways for converting standard five gallon buckets into tool holders, certain problems remain unaddressed by the prior designs. It will be appreciated that hand tools are of different lengths and sizes, and while some sizes of tools can be retained by the annular rings of the Deyesso and Mains devices, or the pockets of the Lindsay device, for instance, other sizes of tools, which would otherwise fit within a standard bucket, could not be readily retained within the prior art rings or pockets. Moreover, the prior art designs do not provide for maximum utilization of the given volume of a standard sized bucket, while maintaining ease of access to the tools carried within the bucket.

SUMMARY OF THE INVENTION

The problems outlined above are in large measure solved by the tool holder in accordance with the present invention. The invention comprises a portable tool container adapted to fit within a standard five gallon bucket, and which is especially designed to maximize use of the given volume of the bucket while providing for ease of access to the tools. The tool holder is divided into vertical tool compartments, preferably by an inclined plane having a spiral shape. The inclined plane decreases in the direction of the center of the insert such that the compartments in the center of the insert are most shallow. Tool return guide-ridges divide the spiral inclined plane into compartments and aid in the return of the tools to the insert. While the tool container is particularly designed to be contained within a container such as a bucket, it can also be used free standing when provided its own bottom wall.

DETAILED DESCRIPTION

Figure 1:
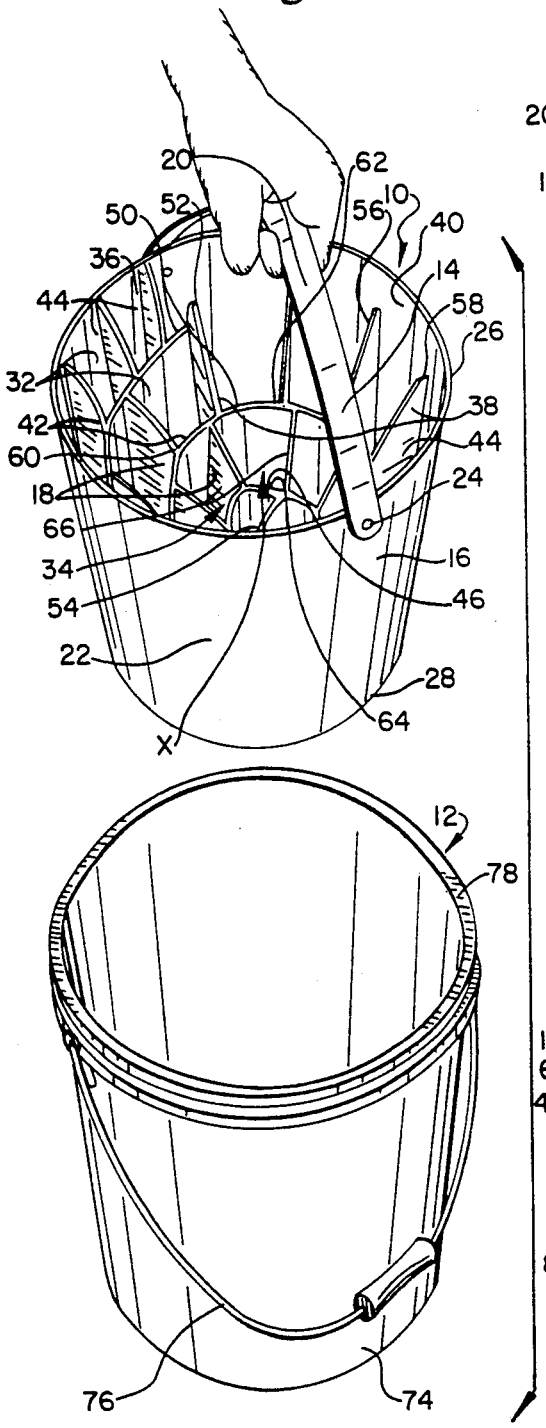
FIG. 1 is a perspective view of the tool holder of the present invention suspended over an empty, common five-gallon dry wall pail.
Figure 2:
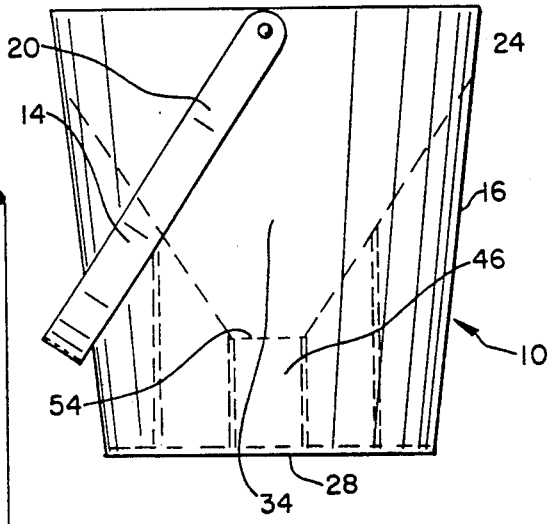
FIG. 2 is a side elevational view of the tool holder showing selected details of the interior structure of the holder in phantom lines.
Figure 3:
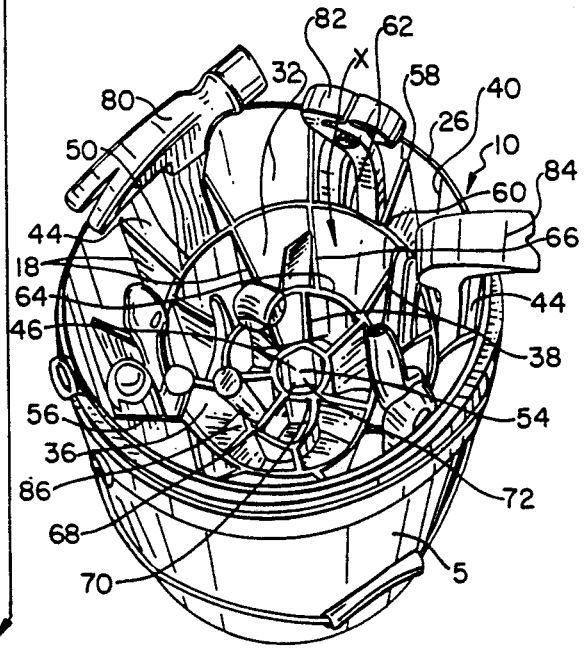
FIG. 3 is a top perspective view of the holder as received within a common five-gallon dry wall pail, depicting typical placement of tools.

In the drawings, FIGS. 1-3 depict a preferred embodiment of the invention providing a tool holder 10 for use with an open-ended container or can, shown as a typical five-gallon bucket 12. The bucket 12 may be a standard paint can, mud wall bucket, dry wall pail or like container.

The tool holder 10 generally comprises a handle 14, an outer side wall 16 and a divider assembly 18. The handle 14 preferably comprises a generally flexible strap-like member 20 attached to the outer surface 22 of the outer side wall 16 with rivets 24 or like attachment devices. Preferably the mode of attachment of the handle 14 with the outer side wall 16 allows pivotal movement of the handle 14 from a first, carrying position above the upper margin 26 of the outer side wall as depicted in FIG. 1 to a second, rest position below the upper margin 26 of the outer side wall as depicted in FIG. 2. It is to be understood that the handle may comprise a relatively rigid bent metal rod or any other suitable handle structure as will be familiar to those having ordinary skill in the art. In an alternative embodiment, finger hole grips (not shown) below the upper margin 26 may substitute for, or supplement, the handle as described above in the preferred embodiment.

The outer side wall 16 is composed of a relatively rigid material such as a suitable synthetic resin compound or like material. In a preferred embodiment, the outer side wall 16 has an inverted frusto-conical configuration, tapering from a large-diameter upper margin 26 to a smaller-diameter bottom 28. The taper of the outer side wall 16 is adapted to allow the outer side wall 16 to be received within an ordinary paint, mud wall or other like bucket 12, as depicted in FIG. 3. However, the outer side wall 16 may be untapered or may taper from a large lower margin to a smaller upper margin, depending on the desired use and application. For example, the relatively rigid composition of the outer side wall allows the invention to be used without the support of a bucket 12, i.e., as a free-standing portable tool holder. If buckets 12 are not available at a worksite, for example, the free-standing mode with no taper or various alternative tapers may be desired or appropriate.

The divider assembly includes a series of concentrically arranged tool compartments 32 within the cavity 34 defined by the outer side wall 16. The compartments 32 are bounded by generally vertically oriented walls 36. The walls 36 include radial sections 38 oriented generally normal to the inner surface 40 of the outer side wall 16 and transverse sections 42 oriented generally normal to radial sections 38. The lower-most limits of the compartments are defined by the bottom 28 of the outer side wall 16.

The compartments 32 progressively decrease in height from the outermost compartments 44 adjacent the inner surface 40 of the outer side wall to the centermost compartments 46 at the center of the cavity 34. Preferably the transverse sections 42 are attached to each other to form a continuous downwardly and inwardly directed inclined, spiralled plane 48. As a result the upper margin 50 of the inclined plane 48 defines a downward spiral. The spiral begins near the inner surface 40 of the outer side wall 16 at a point 52 proximate the upper margin 26 of the outer side wall 16, and ends in the region of the centermost compartments 46 at a point 54 between the upper margin 26 and the bottom 28 of the outer side wall 16. Since the bottom 28 of the outer side wall 16 preferably represents a constant lowermost limit for all compartments, the shallowest compartments are the centermost compartments 46 and the deepest compartments are the outermost compartments 44. Preferably the upper margins 56 of the radial sections 38 are inclined or tapered from the peripheral portions 58 of the upper margins 56 to the medial portions 60 of the upper margins 56, as depicted in FIGS. 1 and 3.

The compartments formed by the above-described tool holder structure have a characteristic appearance and composition defined by the radial sections 38 and inclined, spiralled plane 48. Typical compartments X are identified in FIGS. 1 and 3. The compartment X includes a generally arcuate back wall 62, a generally arcuate front wall 64, and side walls 66. The side walls 66 present downwardly sloped upper margins 67. The central compartment 68 is the only compartment to deviate substantially from the above-described typical configuration. The central compartment 68 is the shallowest compartment and is formed from the convergence of the generally arcuate front walls 64 of the compartments adjacent the central compartment. As such, the central compartment 68 is a generally vertically oriented shallow cylinder having an arcuate outer wall 70 defining a central lumen 72 centered approximately on the central portion of the bottom 28 of the outer side wall 16.

Referring to FIGS. 1 and 3, it will be seen that the tool holder 10 is readily receivable within a standard five gallon bucket 12. The bucket 12 includes a bottom wall, and generally cylindrical, upwardly and outwardly tapered side wall 74. Handle 76 is swingably carried by the side wall 74, proximal the rim 78 of the bucket 12.

In contrast to the conventional tool box in which tools rest horizontally, often in several layers in the same compartment, the tool holder of the present invention has a vertical tool storage orientation and many separate tool compartments each adapted to hold one or two tools. The vertical tool storage orientation and the open faced compartments make it possible for the tool user to determine at a glance if a tool is present and where it is located. For example, tools such as hammers 80, long-handled metal pincers 82 and crowbars 84 are placeable in the outermost compartments 44 whereas tools such as short-handled screwdrivers 86 are conveniently located in the centermost compartments.

With appropriate placement of tools in the various sized compartments, each tool is adequately exposed to allow the user to grip the tool properly for rapid and safe removal. The tapered radial sections 38 provide tool return guide ridges allowing for rapid and safe return of tools to the appropriate compartments. The gradual inclined spiral arrangement of storage compartments in the preferred embodiment provides suitable locations for tools of various lengths, from small knives to hammers. The progressive decrease in height of compartments from the peripheral region to the central region of the tool holder prevents unused tools from spilling out or getting hooked out of the holder as other tools are removed, and provides for ample hand access to the smaller tools.

Having disclosed the subject matter of this invention, it should be apparent that many substitutions, modifications and variations of the invention are possible in light of the above teachings. It is therefore to be understood that the invention as taught and described herein is only limited to the extent of the breadth and scope of the appended claims.

What is claimed is:

1. A portable tool holder for organizing and arranging tools, comprising:

(a) an outer side wall having an internal surface defining an internal tool holder cavity; and (b) dividing means for dividing said cavity into a plurality of compartments for holding individual ones of said tools, said dividing means including an upright spiralled wall presenting an upper margin operably coupled to said side wall and a lower margin, said dividing means spiralled wall upper margin spiralling inwardly and downwardly within said cavity toward an inner portion of said cavity, whereby the spiralled wall upper margin and lower margin present a decreasing spiralled wall height therebetween as measured radially inwardly and downwardly within said cavity, said outer side wall being generally cylindrical in shape, and said dividing means including a plurality of upright, generally radially oriented divider walls having upper margins said radially oriented divider walls being oriented transverse to said spiralled wall and interconnecting portions of said spiralled wall to define tool receiving compartments, the upper margins of the radially oriented divider walls sloping inwardly and downwardly toward said inner portion of the cavity, said tool receiving compartments thereby extending within the tool holder cavity and progressively decreasing in height from the outermost compartments adjacent the internal surface of the outer side wall to an innermost compartment at said inner portion of the tool holder cavity.

2. The portable tool holder as set forth in claim 1, wherein said dividing means upper margins extend downwardly and inwardly within said cavity in an inclined spiral orientation.

3. The portable tool holder as set forth in claim 2, said radially oriented divider walls being oriented generally normal to said spiralled wall.

4. The portable tool holder as set forth in claim 1, including a bottom wall operably coupled to said side wall.

* * * * *